United States Patent [19]

Matysik et al.

[11] Patent Number: 4,913,056

[45] Date of Patent: Apr. 3, 1990

[54] CARTRIDGE

[75] Inventors: Peter Matysik, Springe; Heinz Wiechmann, Garbsen, both of Fed. Rep. of Germany

[73] Assignee: Wilhelm Brenneke KG Fabrikation Von Jagdgeschossen, Langenhagen, Fed. Rep. of Germany

[21] Appl. No.: 350,301

[22] Filed: May 5, 1989

[30] Foreign Application Priority Data

May 7, 1988 [DE] Fed. Rep. of Germany ..... 3815738

[51] Int. Cl.[4] ..... F42B 5/02

[52] U.S. Cl. ..... 102/439; 102/448; 102/501; 102/517

[58] Field of Search ..... 102/430, 439, 447, 448, 102/449, 450, 451, 453, 501, 517, 518, 519, 520, 522, 523

[56] References Cited

U.S. PATENT DOCUMENTS

| | | | |
|---|---|---|---|
| 3,398,682 | 8/1968 | Abela | 102/439 |
| 4,063,511 | 12/1977 | Bullard | 102/439 |
| 4,157,684 | 6/1979 | Clausser | 102/447 |
| 4,471,699 | 9/1984 | Turco et al. | 102/501 |
| 4,538,520 | 9/1985 | Schmitz | 102/439 |

FOREIGN PATENT DOCUMENTS

| | | | |
|---|---|---|---|
| 2024820 | 8/1971 | Fed. Rep. of Germany | 102/532 |
| 2615859 | 10/1977 | Fed. Rep. of Germany . | |
| 2929628 | 2/1981 | Fed. Rep. of Germany . | |
| 3241149 | 6/1984 | Fed. Rep. of Germany . | |

*Primary Examiner*—Harold J. Tudor

*Attorney, Agent, or Firm*—Penrose Lucas Albright

[57] ABSTRACT

In a cartridge fitted with a gun-barrel projectile comprising a lead head and a resilient body joined to the head by a plug-in connection, the connection is designed to be a positive and exact fit, and the body is constructed with a forward end part adjacent the head, a rod-like central part, and a rearward end part in the form of a flat top piston connected to the central part at a predetermined breakage point whereby the rearward part can break from the central part and move forwards, hence moving the center of gravity of the projectile forwards, when the cartridge is fired.

7 Claims, 2 Drawing Sheets

CARTRIDGE

BACKGROUND OF THE INVENTION

1. Field of the Invention

The invention relates to a cartridge including a gun-barrel projectile comprising a lead head provided with a tip, and a body of resilient material which is joined to the head by means of a plug-in connection.

2. Summary of the Prior Art

DE-PS 32 41 149 discloses an example of such a cartridge in which the plug-in connection of the Projectile is formed by a sleeve-like projection inside the cylindrical lead head, and a cup-shaped part of the resilient body on which a pin pointing in the firing direction is formed for engagement in the sleeve-shaped projection of the head. Arranged concentrically with this pin is a wedge-sectioned ring which engages in a wedge-shaped annular recess in the lead head. The plug-in connection formed by these parts is not quite fully interfitting insofar as in the loading condition of the cartridge, there remains a gap between the front surface of the wedge-shaped ring and the pin on the one hand and the front surface of the associated recesses in the head on the other hand, with the result that, after firing of the cartridge, the plug endeavors to fill the gap completely. This leads not only to radial deformations of the comparatively soft lead head, but also to the destruction of the plug, which significantly impairs the accuracy of the projectile in flight.

A further drawback of this known cartridge construction is that the center of gravity of the projectile lies too far towards the rear, as a consequence of the cup-shaped part of the body extending in the direction of the propelling charge disposed in the cartridge behind the projectile.

SUMMARY OF THE INVENTION

It is an object of the invention, therefore, to provide an improved cartridge of type hereinbefore defined, wherein radial deformations of the lead head and destruction of the body of the projectile on firing the cartridge are avoided, and the center of gravity of the projectile lies well forward.

To this end, according to the invention there is provided a cartridge having a cartridge case, a gun-barrel projectile disposed in said case, and a propelling charge in said case behind said projectile, said gun-barrel projectile comprising a lead head provided with a tip, a body of resilient material, and means on said head and said body defining an exactly fitting plug-in connection joining said body to said head, said body comprising a forward end part adjacent said head, a rearward end part in the form of a flat-topped piston remote from said head, a rod-like central part between said forward and rearward end parts, and means connecting said rearward end part to said rodlike central part so as to define a predetermined breakage point.

As a result of constructing the connection between the lead head and the resilient body as a plug-in connection fitting exactly at all its parts, there are no gaps between these parts in the loading condition of the cartridge. Thus, when the high gas pressures which develop on firing the cartridge exert their action, deformation of the lead head and destruction of the connection between the body and the head are avoided.

In addition, as a result of the predetermined breakage point formed between the central part and the rearward end part of the body, the rearward end part will break from the central part at this point when the cartridge is fired and will move forward along the central part under the action of the gases generated by the ignited charge to abut against the rear end surface of the forward end part of the body, where the rearward end part is preferably held by a projection on the central part. As a result, the center of gravity of the projectile consisting of the lead head and the resilient body is shifted forwards in the direction of the muzzle of the barrel.

Further characteristics of the invention will become apparent from the following description of a preferred embodiment and the accompanying diagrammatic drawings.

DESCRIPTION OF THE PREFERRED EMBODIMENT

Figure 1:
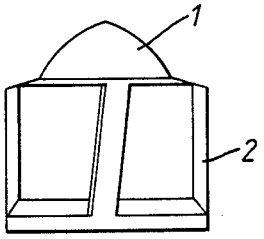
FIG. 1 shows a side view of the lead head of one embodiment of the projectile of a cartridge in accordance with the invention.
Figure 2:
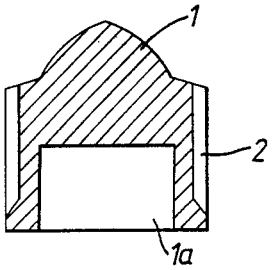
FIG. 2 shows an axial section through the lead head shown in FIG. 1.
Figure 3:
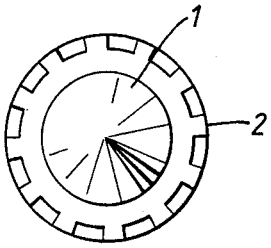
FIG. 3 shows a top view of the lead head shown in FIGS. 1 and 2.

FIGS. 1 to 3 show the lead head 1 of a cartridge projectile, the head having a cylindrical part provided with external ribs 2 extending slantwise to its longitudinal axis.

Figure 4:
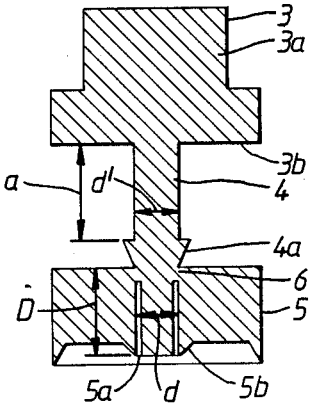
FIG. 4 shows an axial section through the body of the projectile of a cartridge in accordance with the invention.

FIG. 4 shows an axial section through a body made of a resilient material, such as a suitable plastics material, and designed to be fitted to the lead head 1. The body comprises a forward part 3, a rod shaped central part 4, and a rearward part 5 in the form of a flat-top piston. This flat-top-piston-like rearward part 5 is connected to the rod-shaped central part 4 by a portion 6 forming a predetermined breakage point, further details of which are described hereinbelow.

As is clearly shown in FIG. 4, the forward part 3 of the body has a cylindrical spigot **3*a* which is arranged to fit tightly and exactly, without any conicity, into a blind recess 1*a* in the lead head 1. This is made particularly clear by FIGS. 5 to 7 in which the walls of the cylindrical spigot 3*a* are shown lying in close contact with the corresponding walls of the blind recess 1*a***, without any gaps therebetween. This constitutes an essential feature of the invention.

As a result of the exact fit of the cylindrical spigot **3*a* into the blind recess 1*a*, a positive plug-in connection is ensured, and the tightness of the joint between the head and the body may be further improved by making the cylindrical spigot 3*a* slightly oversize relative to the blind recess 1*a*. In order to prevent detachment of the lead head 1 from the body and to hold them securely together during the flight of the projectile after the cartridge has been fired, the lead head 1** may be additionally keyed to the cylindrical spigot 3*a* of the forward part 3 of the body by means of at least one punched-in area 7 of the head. At this location 7, the soft material of the lead head 1 is forced into the cylindrical spigot 3*a* of the body.

In the embodiment illustrated, the central part 4 and the rearward part 5 of the body are circular in cross-section, and the rearward part 5 is provided with an annular groove 5*a* having a diameter d which is identical to the diameter d' of the central part 4. As FIGS. 4 and 5 show, the opening of the annular groove 5*a* faces in the direction away from the forward part 3, i.e. rearwards, and is surrounded by a lip 5*b*.

The predetermined breakage point 6, which ruptures under shear stress exerted when the cartridge is fired, is formed by the surface region of the rearward part 5 between the central part 4 and the end of the annular groove 5*a* in the rearward part 5.

The forward part 3 of the body has a rear end area 3*b* into which the central part 4 merges, and in the arrangement shown the central part 4 is provided with a projection 4*a* which is designed to act as a support for the rearward part 5 during the flight of the projectile as described below, the distance between a the projection 4*a* and the end area 3*b* being equal to the thickness D of the rearward part 5. The projection 4*a* forms an integral portion of the central part 4, and is thus made of the same material, i.e. a resilient plastics material.

Figure 5:
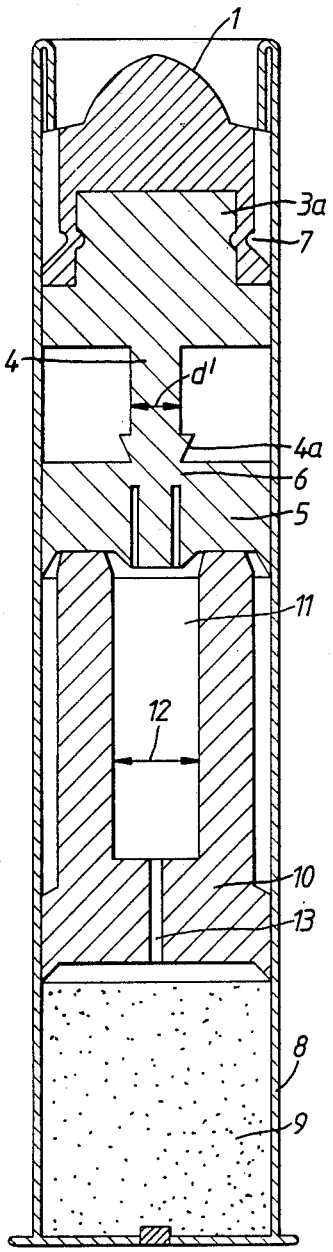
FIG. 5 shows an axial section through an embodiment of a cartridge in accordance with the invention incorporating a projectile formed from the head and body shown in FIGS. 1 to 4.
Figure 7:
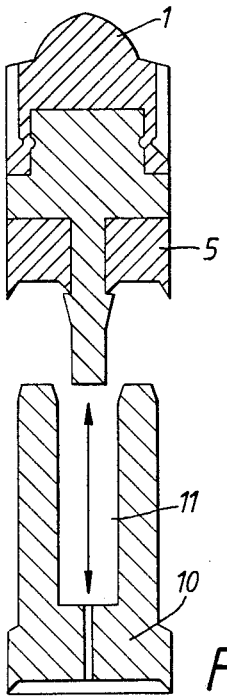

In FIG. 5 a complete cartridge is shown, having a cartridge case 8 containing a propelling charge 9 at its closed rear end, and the projectile retained within its open forward end. Between the rearward part 5 of the projectile body and the propelling charge 9 there may be an intermediate piece 10 as shown. This avoids, if desired the use of an excessive volume of powder in long cartridge cases. The intermediate piece 10 is provided with a central cylindrical chamber 11 having a diameter 12 which is greater than the diameter d' of the central part 4 of the projectile body. As a result, following firing of the cartridge as described below, the central part 4 of the body can move into the chamber 11 without deformation and disturbance. The chamber 11 communicates with the rear part of the cartridge case 8 containing the propelling charge 9 through a hole 13 of a size which prevents particles of powder from entering the chamber 11 but permits the entry of highly pressurized gases generated when the cartridge is fired. This leads to the condition that, after the projectile and intermediate piece have left the muzzle of the barrel following firing of the cartridge, ambient air pressure prevails externally while an excess pressure prevails in the chamber 11 of the intermediate piece 10, thus ensuring a trouble-free separation of the intermediate piece 10 from the projectile as shown in FIG. 7.

Figure 6:
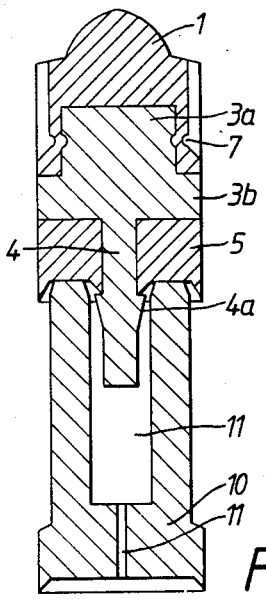
FIGS. 6 and 7 show axial sections through the projectile and an intermediate member of the cartridge of FIG. 5 during and after firing respectively.

The operation of the cartridge and its gun-barrel projectile is as follows. In the loaded condition, i.e., before the firing of the propelling charge 9, the individual parts of the cartridge are in the position shown in FIG. 5. When the cartridge is fired the propelling charge 9 is ignited and the gas pressure generated acts on the rearward part 5 of the projectile body, via the intermediate piece 10 when present, causing a rupture of the predetermined breakage point 6 and the rearward part 5 to move forwards along the central part 4 of the body, i.e., in the direction of the muzzle of the gun-barrel. During this movement the rearward part 5 passes beyond the projection 4*a* of the central part 4 to the position shown in FIG. 6, in which the rearward part 5 abuts against the rear end area 3*b* of the forward part 3 of the body and is retained in this position by the projection 4*a* engaging behind the part 5. The center of gravity of the projectile is thus moved favorably forward and the head 1 and the body of the projectile form an inseparable unit for onward travel to the target. If an intermediate piece 10 is used, this is propelled from the gun-barrel with the projectile as shown in FIG. 6, but quickly separates therefrom as described above after leaving the barrel.

We claim:

1. A cartridge having a cartridge case, a gun barrel projectile disposed in said case, and a propelling charge in said case behind said projectile, said gun barrel projectile comprising: a lead head provided with a tip; a body of resilient material; and means on said head and said body defining an exactly fitting plug-in connection joining said body to said head, said body comprising a forward end part adjacent said head and delimited by a rear end area; a rearward end part in the form of a flat-topped piston remote from said head; a rod-like central part between said forward and rearward end parts, said rod-like central part merging into said rear end area of said forward end part; and means connecting said rearward end part to said rod-like central part so as to define a predetermined breakage point designed to rupture on firing said cartridge to allow said rearward end part to move forwardly along said rod-like central part towards said forward end part, said rod-like central part being provided with a projection which acts as a support for said rearward end part during flight of said projectile after said cartridge has been fired, the distance between said rear end area of said forward end part and said projection being equal to the thickness of said rearward end part.

2. A cartridge according to claim 1, wherein said forward end part has a cylindrical spigot portion, and said head is provided with a blind recess for receiving said spigot portion as an exact fit to form said plug-in connection.

3. A cartridge according to claim 1, wherein said central part and said rearward end part of said body have a circular cross-section, and said rearward end part is provided with an annular groove having a diameter which is substantially identical to the diameter of said central part.

4. A cartridge according to claim 2, wherein said head is provided with at least one inwardly depressed area for engaging said spigot portion of said forward end part to augment said connection between said head and said body.

5. A cartridge according to claim 1, wherein said cartridge includes an intermediate member in said cartridge case between said projectile and said propelling charge, said intermediate member being provided with a central cylindrical chamber having a diameter greater than the diameter of said rod-like central part of said body of said projectile.

6. A cartridge according to claim 5, wherein said intermediate member includes a hole by which said central cylindrical chamber is in communication with the portion of said cartridge case containing said propelling charge.

7. A cartridge having a cartridge case, a gun barrel projectile disposed in said case, and a propelling charge in said case behind said projectile, said gun barrel projectile comprising: a lead head provided with a tip; a body of resilient material; means on said head and said body for defining an exactly fitting plug-in connection joining said body to said head, said body comprising a forward end part adjacent said head and delimited by a rear end area; a rearward end part in the form of a flat-topped piston remote from said head, said rearward end part having a circular cross-section; a rod-like central part having a circular cross-section between said forward and rearward end parts, said rod-like central part merging into said rear end area of said forward end part; and means for connecting said rearward end part to said rod-like central part so as to define a predetermined breakage point designed to rupture on firing said cartridge to allow said rearward end part to move forward along said rod-like central part towards said forward end part, said means for connecting said rearward end part to said rod-like central part comprising an annular groove in said rearward end part, said groove opening in a direction sway from said forward end part and having a diameter which is substantially identical to the diameter of said rod-like central part, said rearward end part having a lip surrounding the opening of said annular groove, and said rod-like central part being provided with a projection which acts as a support for said rearward end part during flight of said projectile after said cartridge has been fired, the distance between said rear end area of said forward end part and said projection being equal to the thickness of said rearward end part.

* * * * *